US009021761B2

(12) United States Patent
Riccobene et al.

(10) Patent No.: US 9,021,761 B2
(45) Date of Patent: May 5, 2015

(54) BUILDING UNIT WITH MATING SIDES

(71) Applicant: Keystone Retaining Wall Systems LLC, Minneapolis, MN (US)

(72) Inventors: Thomas S. Riccobene, Albuquerque, NM (US); Robert A. MacDonald, Plymouth, MN (US)

(73) Assignee: Keystone Retaining Wall Systems LLC, Minneapolis, MN (US)

( * ) Notice: Subject to any disclaimer, the term of this patent is extended or adjusted under 35 U.S.C. 154(b) by 0 days.

(21) Appl. No.: 14/204,501

(22) Filed: Mar. 11, 2014

(65) Prior Publication Data

US 2014/0260059 A1 Sep. 18, 2014

Related U.S. Application Data

(60) Provisional application No. 61/791,089, filed on Mar. 15, 2013.

(51) Int. Cl.

| | |
|---|---|
| ***E04B 2/00*** | (2006.01) |
| ***E04C 1/00*** | (2006.01) |
| ***E04B 2/08*** | (2006.01) |

(52) U.S. Cl.
CPC .... *E04C 1/00* (2013.01); *E04B 2/08* (2013.01)

(58) Field of Classification Search
CPC ..... E04F 13/147; E01C 5/00
USPC ..... 52/588.1, 311.2, 604, 605, 608
See application file for complete search history.

(56) References Cited

U.S. PATENT DOCUMENTS

| | | | | |
|---|---|---|---|---|
| 2,271,728 | A * | 2/1942 | Bainbridge | 52/105 |
| 3,394,521 | A | 7/1968 | Coleman | |
| 3,906,665 | A * | 9/1975 | Medlin | 47/86 |
| 4,354,773 | A | 10/1982 | Noack | |
| 4,761,095 | A | 8/1988 | Bartlechner | |
| 4,773,790 | A | 9/1988 | Hagenah | |
| 5,267,810 | A | 12/1993 | Johnson | |

(Continued)

FOREIGN PATENT DOCUMENTS

| | | |
|---|---|---|
| EP | 0171417 | 2/1986 |
| WO | 2004085755 | 10/2004 |

OTHER PUBLICATIONS

Canyon Stone, CobbleTop and Sereno Stone Brochures, Riccobene Hardscape Innovations, 2010, pp. 1-11.

(Continued)

*Primary Examiner* — Basil Katcheves
(74) *Attorney, Agent, or Firm* — Greer, Burns & Crain, Ltd.

(57) ABSTRACT

A building unit including upper and lower surfaces, and a plurality of side surfaces extending between the upper and lower surfaces defining a generally trapezoidal shape in plan view. The unit includes a first pair of the side surfaces, located on opposite sides of the unit and extending non-linearly and generally obliquely with respect to each other in plan view, where each side surface of the first pair has a midpoint bisecting it into two portions. The portions on each side of the midpoint are a 180° rotational image of the other portion about the midpoint. One side surface of the first pair is longer than the other, and the longer side surface includes a midsection of the same length and configuration as the other, shorter side surface. Each of the shorter and longer side surfaces interlocks with either the shorter or longer side surface of another like building unit.

19 Claims, 9 Drawing Sheets

(56) References Cited

U.S. PATENT DOCUMENTS

| | | | | |
|---|---|---|---|---|
| D343,238 | S | 1/1994 | Hair | |
| 5,286,139 | A | 2/1994 | Hair | |
| 5,348,417 | A | 9/1994 | Scheiwiller | |
| 5,645,369 | A * | 7/1997 | Geiger | 404/34 |
| D397,802 | S | 9/1998 | Terry | |
| 5,884,445 | A * | 3/1999 | Woolford | 52/311.2 |
| 5,921,705 | A * | 7/1999 | Hodson et al. | 404/41 |
| 5,984,589 | A * | 11/1999 | Ciccarello | 405/284 |
| 6,447,213 | B1 | 9/2002 | MacDonald | |
| 6,471,440 | B1 * | 10/2002 | Scheiwiller | 404/39 |
| 6,615,561 | B2 | 9/2003 | MacDonald et al. | |
| 6,854,231 | B2 | 2/2005 | MacDonald et al. | |
| 6,907,705 | B2 | 6/2005 | Dean et al. | |
| D522,667 | S | 6/2006 | Castonguay et al. | |
| D536,058 | S | 1/2007 | Riccobene | |
| 7,168,892 | B1 * | 1/2007 | MacDonald et al. | 405/284 |
| D537,959 | S | 3/2007 | Castonguay et al. | |
| 7,393,155 | B2 | 7/2008 | Riccobene | |
| 7,637,688 | B2 | 12/2009 | Riccobene | |
| D624,202 | S | 9/2010 | Thomassen et al. | |
| D674,510 | S | 1/2013 | Riccobene | |
| 2003/0070384 | A1 | 4/2003 | Drost | |
| 2004/0191461 | A1 | 9/2004 | Riccobene | |
| 2005/0166517 | A1 | 8/2005 | Manthei | |
| 2007/0077387 | A1 | 4/2007 | Riccobene | |
| 2008/0209828 | A1 | 9/2008 | Riccobene | |
| 2010/0236174 | A1 * | 9/2010 | Castonguay et al. | 52/311.1 |
| 2012/0003040 | A1 * | 1/2012 | Castonguay et al. | 404/41 |
| 2012/0189386 | A1 | 7/2012 | Castonguay et al. | |

OTHER PUBLICATIONS

Country Stone Everest Edging Stone Brochure, retrieved from Lowes.com on the Internet, Aug. 2, 2012, pp. 1-2.

Allen + Roth Bertram Retaining Wall Block Brochure, retrieved from Lowes.com on the Internet on Apr. 10, 2014, p. 1.

* cited by examiner 54
54
54

BUILDING UNIT WITH MATING SIDES

PRIORITY CLAIM

This application claims priority of U.S. Provisional Application Ser. No. 61/791,089, filed Mar. 15, 2013.

FIELD OF THE PRESENT DISCLOSURE

This disclosure relates to building units forming a landscape edge, surface covering and/or wall structure, and more specifically relates to stones, bricks, pavers and tiles.

BACKGROUND OF THE INVENTION OF THE PRESENT DISCLOSURE

It is well known to cover surfaces, such as walkways, driveways, patios, floors, work surfaces, walls and other interior or exterior surfaces with stones, bricks, pavers, tiles and other architectural surface covering units. It is further known to construct walls and other structures with stone and bricks. Natural stone surface coverings and structures are constructed by cutting and fitting irregularly sized and shaped stones. The work requires a skilled stonemason to select, cut and fit the stone. It is labor intensive, and accordingly expensive. Custom built natural stone surfaces and structures, however, are very attractive and desirable.

Conventional surface coverings and structures are also constructed of manufactured pavers, bricks, tiles or other building units. Manufactured units are typically provided in geometric shapes, such as squares, rectangles and hexagons, or combinations thereof. Surfaces covered with manufactured units are typically laid in repeating patterns, which, in certain applications, may lack the desired visual interest.

Further, due to the shapes of certain conventional building units, they may be limited to a small number of applications. For example, it may be difficult to make a curved pathway or a tree ring out of square or rectangular units.

Another problem with such repeating patterns of many conventional surface coverings is that the units (i.e., the squares, rectangles and/or hexagons) within the surface covering can easily shift over time, such that adjacent units will end up being out of alignment with each other. The result is a surface covering that is intended to be based on a repeating pattern with a uniform look, but that includes one or more sections where the pattern is not followed due to such misalignments, thereby creating a disordered appearance.

SUMMARY OF THE INVENTION

One of the objects of the present invention is to provide building units with features designed to reduce the amount of shifting with respect to adjacent units, such as by providing side surfaces shaped to interlock with the side surfaces of adjacent units, thereby providing structural integrity.

Another one of the objects of the present invention is to provide building units that can be used in a variety of different applications, such as pavers, edgers and walls, and that can be laid in straight configurations, curved configurations, or a combination of straight and curved configurations.

These and other objects are discussed below or will be apparent from the following detailed description of the present invention.

In particular, embodiments of the present invention relate to a building unit that includes an upper surface, a lower surface, and a plurality of irregularly shaped side surfaces at least partially extending between the upper surface and the lower surface defining a generally trapezoidal shape in plan view. There are preferably a first pair of the side surfaces, located on opposite sides of the building unit, that extend generally obliquely with respect to each other when considered in plan view, with each of the first pair of side surfaces being non-linear and having a midpoint bisecting each side surface into two portions. The portions on each side of the midpoint are a 180 degree rotational image of the other portion about the midpoint. One of the first pair of side surfaces is longer than the other, and the longer side surface includes a midsection that has the same length and configuration as the other, shorter side surface. The shorter side surface of the first pair of side surfaces is configured and arranged to interlock with either the shorter or longer of the first pair of side surfaces of another like building unit, and the longer side surface of the first pair of side surfaces is configured and arranged to interlock with either the shorter or longer of the first pair of side surfaces of another like building unit.

The present invention also relates to a building unit that includes an upper surface, a lower surface; and a plurality of irregular side surfaces at least partially extending between the upper surface and the lower surface defining a generally trapezoidal shape in plan view. A first pair of the side surfaces, located on opposite sides of the building unit, extend generally obliquely with respect to each other when considered in plan view. Each of the first pair of side surfaces is non-linear and has a midpoint bisecting each side surface into two portions, with the portions on each side of the midpoint being a 180 degree rotational image of the other portion about the midpoint. At least a portion of each of the first pair of side surfaces is configured and arranged to interlock with either of the first pair of side surfaces of another like building unit. An axis is defined as extending between the midpoints of the first pair of side surfaces, and the shorter of the first pair of side surfaces is nearly orthogonal to the axis, while the longer of the first pair of side surfaces is oblique the axis. The unit also includes a second pair of side surfaces, located on opposite sides of the building unit, wherein each of the second pair of side surfaces extends between the side surfaces of said first pair of side surfaces. The second pair of side surfaces are generally parallel to each other and the axis, with one of the second pair of side surfaces being longer than the other. Each of the second pair of side surfaces includes a first sub-side surface and a second sub-side surface, with the first sub-side surface of the longer of the second pair of side surfaces being a mirror image of the first sub-side surface of the other, shorter of the second pair of side surfaces, such that the first sub-side surface of the longer side surface of one building unit is configured and arranged to interlock with the first sub-side surface of the shorter side surface of another like building unit.

The present invention also relates to a structure made from a plurality of building units arranged adjacent to each other, where each of the building units includes an upper surface, a lower surface, and a plurality of side surfaces at least partially extending between the upper surface and the lower surface defining a generally trapezoidal shape in plan view. The plurality of side surfaces includes: (i) a first pair of side surfaces, located on opposite sides of the building unit and defined as a first side surface and a third side surface, and (ii) a second pair of said side surfaces, located on opposite sides of the building unit and defined as a second side surface and a fourth side surface. The first side surface and the third side surface are non-linear and extend generally obliquely with respect to each other, when considered in plan view. Additionally, the first and third side surfaces each define a midpoint bisecting each side surface into two portions, with the portions on each side of the midpoint being a 180° rotational image of the other portion about the midpoint. With regard to the second side surface and the fourth side surface, these side surfaces extend generally parallel with respect to each other, when considered in plan view. The plurality of building units are arranged in a pattern in which adjacent building units are positioned with the first side surface of one building either mating with the first side surface of an adjacent building unit, or with the first side surface of one building unit mating with the third side surface of an adjacent building unit.

The present invention also relates to a structure composed of the building units as described in the previous paragraph, however in a different pattern. In this pattern, the plurality of building units are arranged with adjacent building units are positioned with: (i) the first side surface of one building unit mating with the first side surface of an adjacent building unit, (ii) the second side surface of one building unit mating with portions of the second and fourth side surfaces of two adjacent building units, (iii) the third side surface of one building unit mating with the third side surface of an adjacent building unit, and (iv) the fourth side surface of one building unit mating with portions of the second and fourth side surfaces of two adjacent building units.

These and other examples of the present invention are discussed below in the following detailed description of the present invention.

DETAILED DESCRIPTION OF THE PREFERRED EMBODIMENTS

Preferred embodiments of the present disclosure are described below by way of example only, with reference to the accompanying drawings.

In the following description, the terms "extending," "along," "rotational," "perpendicular," and "parallel" should be understood not to necessarily refer to perfect alignment, direction, or orientation. Instead, such alignment, direction, or orientation can vary given manufacturing tolerances or designed variance, for instance, to provide a more natural effect. "Opposite" faces or surfaces need not be perfectly opposite for particular units, but can be generally on opposite sides of the unit. "Essentially" (e.g., "essentially of the same length," "essentially of the same configuration," etc.) refers to an overall state. The term "between" can be considered inclusive or exclusive, depending on the context. "Downwardly" refers to a direction from the top or upper, surface towards the bottom or lower, surface. "First side surface," "second side surface," etc. are used for clarity of description, and are not intended to require a particular order. For instance, "first side surface" can refer to a left side and "second side surface" to a right side, or vice versa.

Figure 1:
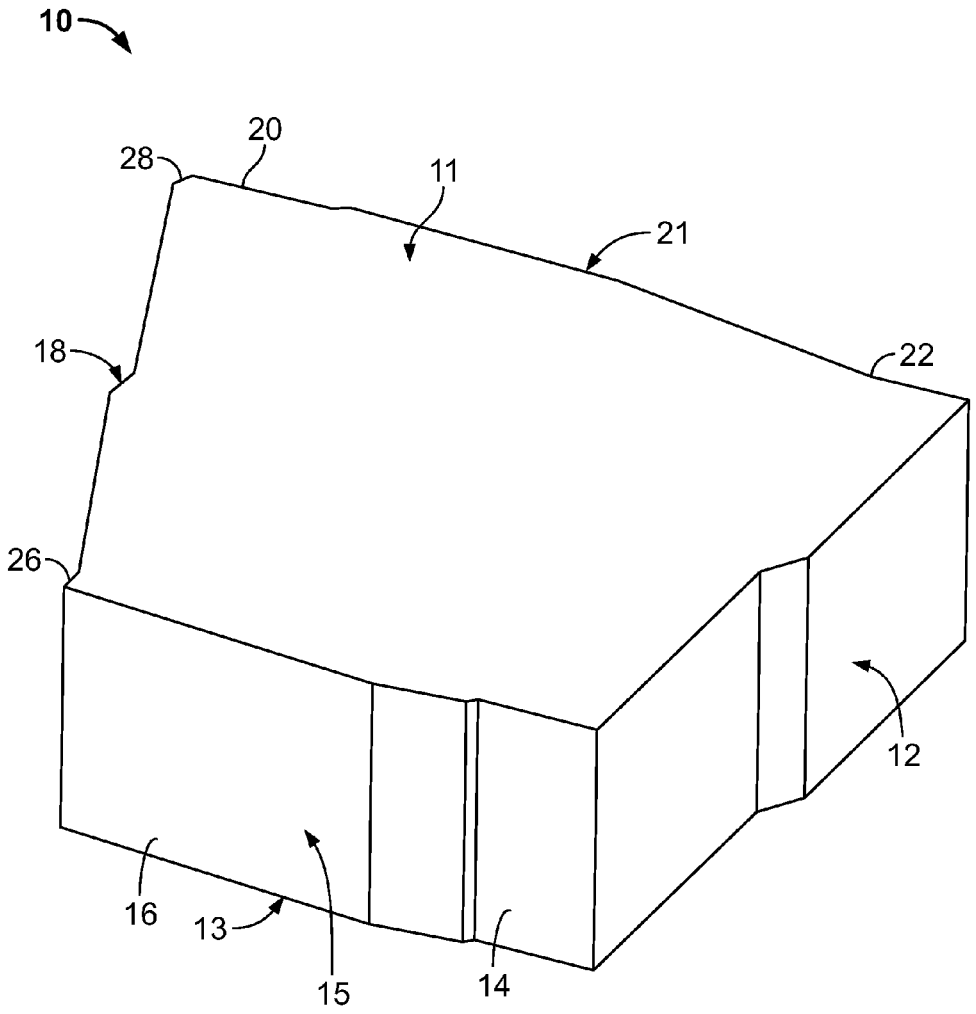
FIG. 1 is a perspective view of an exemplary building unit in accordance with an embodiment of the present disclosure.
Figure 2:
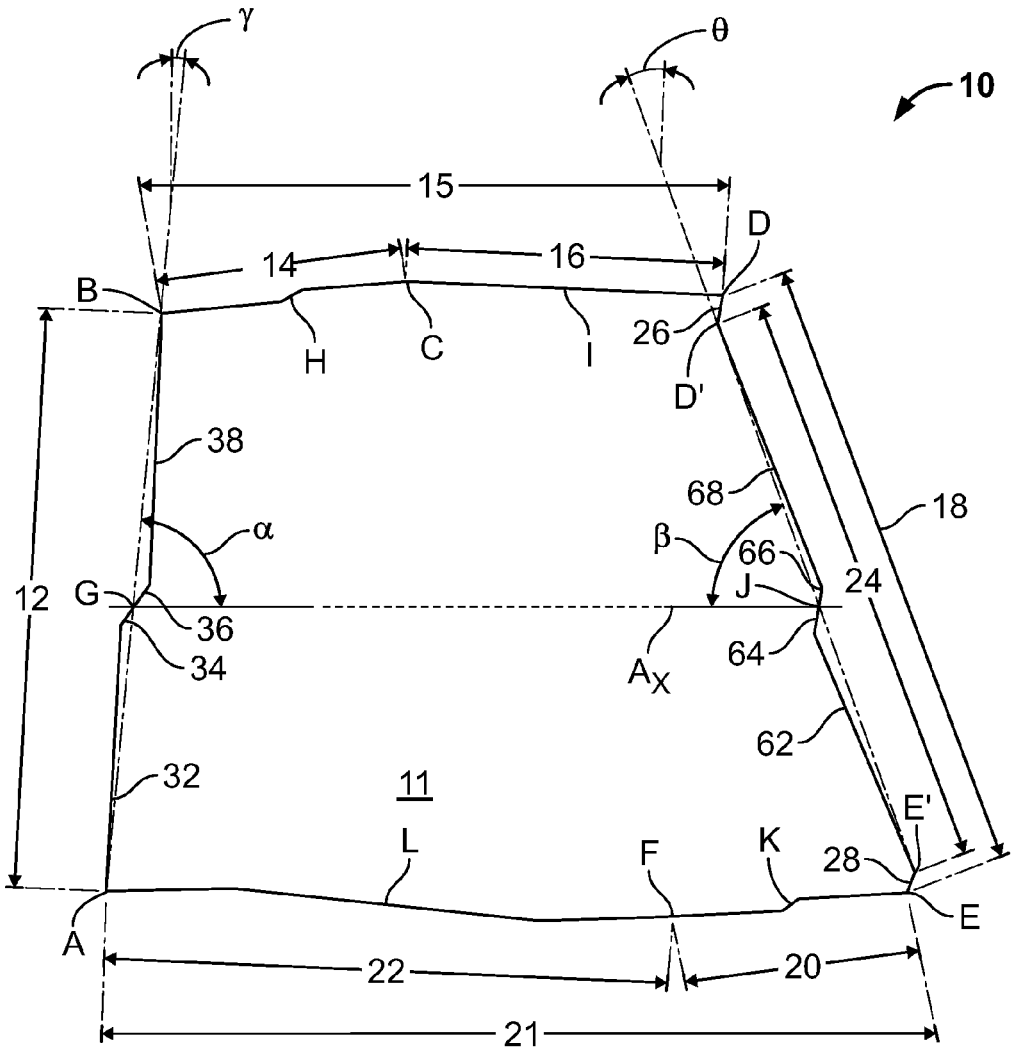
FIG. 2 is a top plan view of the building unit shown in FIG. 1.

Referring now to FIGS. 1-2, a preferred embodiment of an exemplary building unit is generally designated 10 and includes an upper surface (or face) 11, a lower surface (or face) 13 on an opposite side of the upper surface 11, and a plurality of side surfaces 12, 15, 18 and 21 that extend at least partially between the upper surface 11 and the lower surface 13. The upper surface 11 can be optionally textured and/or include molded impressions or other features. FIG. 1 shows smooth, planar side surfaces 12, 15, 18 and 21 extending completely between the upper and lower surfaces 11 and 13, which is desirable in some embodiments to provide a modern or contemporary look. In other embodiments, however, it is contemplated that the side surfaces do not extend completely from top to bottom. In one alternative embodiment, the side surfaces define a base portion of the unit and an upper portion is provided that has a different shape (geometric or not) as compared to the main or base portion of the unit, with an angled transitions between the upper portion and the side surfaces of the base. In another alternative embodiment, the upper portion of the unit is sculpted to include natural rock features. For the purpose of this application "natural rock features" means false joints, cavities, fissures, planar offsets, shale layers, chips and/or other surface irregularities, edge irregularities that generate variable width gaps between units, and surface textures that singularly or in combination lend a natural rock or stone appearance to the unit.

As can be seen in FIG. 2, in this embodiment, the building unit 10 can be considered as being of a generally trapezoidal shape in plan view. However, as described below, the side surfaces 15 and 21, which would correspond to the parallel sides of an actual trapezoid, are not defined by a pair of parallel straight lines, but are each instead made up of a plurality of sub-sections that are designed to mate with an adjacent unit in a complementary manner, as described in detail below.

Similarly, the obliquely angled side surfaces 12 and 18 are not defined by a pair of straight lines, but are each instead complementarily shaped to mate with itself (i.e., side surface 12 can mate with side surface 12 of another unit, and side surface 18 can mate with side surface 18 of another unit), or with the other obliquely shaped side surface (i.e., side surface 12 of one unit can mate with side surface 18 of another unit, and vice versa).

Nor is the shape of the building unit 10 even an actual quadrilateral, as all of the sides (save for side 16) are preferably irregularly shaped, including variations along each of the sides. However, as can be seen in FIG. 2, the overall shape of building unit 10 evokes the general shape of a trapezoid because one pair of opposite side surfaces 15 and 21 gives the appearance of two approximately parallel sides of different lengths, and another pair of opposite side surfaces 12 and 18 gives the appearance of two obliquely angled sides extending between the side surfaces 15 and 21. The relative length of the side surfaces is exemplary, and may be differently scaled in other embodiments. For example, side surfaces 15 and 21 could be made longer relative to opposed sides 12 and 18 to form an elongated generally trapezoid shape in plan view.

In particular, FIG. 2 shows a first side surface 12 defined as extending between points A and B, a second side surface 15 that extends between points B and D, a third side surface 18 that extends between points D and E, and a fourth side surface 21 between points E and A.

The first side surface 12 and the third side surface 18 can be considered as a first pair of side surfaces that are located on opposite sides of the building unit 10 and that extend generally obliquely with respect to each other, when considered in plan view. Although side surfaces 12 and 18 are not planar and are preferably irregular, they can be considered as extending generally in the directions shown by the double arrow lines adjacent the reference numbers 12 and 18. By "irregular," it is meant that the side surface appears jagged or rough hewn and/or includes complex curves, and is not merely a straight line or simple curve, e.g., a circular arc (though the surface contour can include one or more portions in a straight line or simple curve).

The first side surface 12 includes a midpoint G, which is located halfway between endpoint A and endpoint B. Although the first side surface 12 can be made of any one of various shapes or configurations, in preferred embodiments, portions of the side surfaces on each side of the midpoint G are rotational images of each other. In other words, at least a portion of the side surface on one side of the midpoint G (segments 32 and 34) is the same length and configuration as a corresponding portion of the side surface on the other side of the midpoint G (segments 36 and 38), rotated 180° about midpoint G. This configuration in which a portion on one side of the midpoint is a 180° rotational image of a portion on the other side of the midpoint will be referred to as an "S-shape section." However, it should be noted that an S-shape section need not be composed of smoothly curving lines, but instead can be irregularly shaped, two or more angular straight line segments, or a combination of straight line segments and curved segments, as long as there is a generally convex portion on one side of the midpoint, and a complementary generally concave portion on the other side of the midpoint, formed by the 180° rotation. The S-shape section can be and preferably is subtle, i.e., it is not obvious or pronounced so that the side surface appears natural. The S-shape sections can be substantially continuous, though this is not required. In other embodiments flat portions, sub-segments, or other features could be included as part of an S-shape section. The mating of two complementary S-shape sections of adjacent units provide a lateral interlock between the units.

As can be seen in FIG. 2, in this embodiment, the line segments 32 and 34 are set at an angle relative to each other. Similarly, the line segments 36 and 38 are set at an angle relative to each other, where the angle between segments 32 and 34 is equal to the angle between segments 36 and 38. Although two line segments are shown on each side of the midpoint G in the FIG. 2 embodiment, there could be more than two line segments on each side of the midpoint G. Further, although straight line segments are preferred for molding purposes, the portions of the first side surface 12 on each side of the midpoint G could include curved segments or other irregular shapes. Further, radiused or beveled corners can be provided between sides. Optionally, the corners between sides can be irregularly shaped in three dimensions to form a natural rock-feature such as a fissure.

Referring to FIG. 2, the third side surface 18 will be discussed next because this side surface 18 is specifically configured to mate with the first side surface 12 of an adjacent unit 10, as well as to mate with the third side surface 18 of an adjacent unit. In order for the third side surface 18 to mate with the first side surface 12, the midsection 24 of the third side surface 18 (i.e., between points D' and E' of FIG. 2) is essentially of the same length and configuration as the first side surface 12. In particular, the midsection 24 includes a midpoint J, which is halfway between endpoints D' and E', and is composed of segment 62 (which corresponds to segment 32 of the first side surface 12), intermediate segments 64 and 66 (which correspond, respectively, to intermediate segments 34 and 36 of the first side surface 12), and segment 68 (which corresponds to segment 38 of the first side surface 12). Although the midsection 24 of the third side surface 18 has been described with regard to multiple segments, this midsection is created using the S-shape concept discussed above. Specifically, the S-shaped midsection 24 is complementary in length and configuration to the S-shaped section of side surface 12.

The third side surface 18 is longer (between endpoints D and E) than the first side surface 12 (between endpoints A and B). Midsection 24 of the third side surface 18 is preferably bordered by inclined portions, such as outwardly inclined portion 26 (between endpoints D and D') and inwardly inclined portion 28 (between E and E'). It should be noted that the outwardly inclined portion 26 and the inwardly inclined portion 28 are also images of one another, rotated 180° about the midpoint J. Accordingly, side surface 18 of one unit can mate with a third side surface 18 of an adjacent unit.

Each inclined portion 26, 28 provides a locking function for holding adjacent units together when assembled, as explained in greater detail below. In addition, the variation provided by inclined portions 26, 28 avoids an exact duplication of the first side surface 12, thereby providing more visual interest. Although straight lines are shown for the inclined portions 26, 28, in FIG. 2, the inclined portions can be curved, irregular or other shapes.

Another feature of the embodiment of the unit 10 shown in FIG. 2 is the manner in which the first side surface 12 and the midsection 24 of the third side surface 18 are oriented with respect to each other. In particular, an axis $A_x$ is defined as extending between the midpoint G of the first side surface 12 and the midpoint J of the midsection 24 of the third side surface 18. As can be seen in FIG. 2, the first side surface 12 is nearly orthogonal to axis $A_x$. More specifically, the general direction of the first side surface 12 (where the general direction is based on a line extending between endpoints A and B) defines an internal angle $\alpha$ with the axis $A_x$, where the angle $\alpha$ is between about 80 and about 90 degrees, i.e., orthogonal or nearly orthogonal, and preferably about 85 degrees.

On the other hand, the third side surface 18 is oblique to the axis $A_x$. More specifically, the general direction of the third side surface 18 defines an internal angle $\beta$ with the axis $A_x$, where the angle $\beta$ is between about 60 and about 75 degrees, and preferably about 70 degrees. The orientation of the third side surface 18 is defined as the general direction of a line extending between endpoints D' and E' of the midsection 24, and not between endpoints D and E.

FIG. 2 also shows two additional angles, $\gamma$ and $\theta$, where angle $\gamma$ is defined as the angle between the general length direction of the first side surface 12 and the normal of axis $A_x$, and angle $\theta$ is defined as the angle between the general length direction of the third side surface 18 and the normal of axis $A_x$. Angle $\gamma$ is the complementary angle of angle $\alpha$, and thus in this embodiment, angle $\gamma$ is between about 0 and about 10 degrees. Likewise, angle $\theta$ is the complementary angle of angle $\beta$, and thus in this embodiment, angle $\theta$ is between about 15 and about 30 degrees. The sum of angles $\gamma$ and $\theta$ is relevant to the degree of curvature when multiple units are aligned, as shown and described in greater detail relative to FIGS. 3 and 4. Preferably, the sum of angles $\gamma$ and $\theta$ can evenly divide 360 degrees.

Next, a second pair of side surfaces consisting of the second side surface 15 (shown towards the upper portion of FIG. 2) and the fourth side surface 21 (shown towards the lower portion of FIG. 2) will be discussed. These side surfaces will be discussed together because, in certain embodiments, portions of the second side surface 15 of one building unit are configured to mate with portions of the fourth side surface 21. The general directions of the second side surface 15 and the fourth side surface 21 are generally parallel to each other, as well as to the axis $A_x$ (where the general direction of side surface 15 can be considered as a line extending between endpoints B and D, and the general direction of side surface 21 can be considered as a line extending between endpoints A and E). As can be seen in FIG. 2, the second side surface 15 can be considered as being composed of a sub-side surface 14 (between points B and C) and a sub-side surface 16 (between points C and D). Similarly, the fourth side surface 21 can be considered as being composed of a sub-side surface 20 (between points E and F) and a sub-side surface 22 (between points F and A).

In particular, as can be seen in FIG. 2, the sub-side surfaces 14 and 16 of second side surface 15 are disposed end-to-end and extend in the same general direction. Similarly, the sub-side surfaces 20 and 22 of fourth side surface 21 are also disposed end-to-end and extend in the same general direction. The combined length of the sub-side surfaces 14 and 16 (of the second side surface 15) is shorter than the combined length of the sub-side surfaces 20 and 22 (of the fourth side surface 21). Further, the relative lengths of the sub-side surfaces can be adjusted, e.g., sub-side surfaces 14 and 20 could be lengthened relative to sub-side surfaces 16 and 22.

Each of the sub-side surfaces 14 and 16 (of the second side surface 15) and the sub-side surfaces 20 and 22 (of the fourth side surface 21) include a midpoint. In particular, sub-side surface 14 includes midpoint H, sub-side surface 16 includes midpoint I, sub-side surface 20 includes midpoint K, and sub-side surface 22 includes midpoint L. As with the midpoints G and J of the first and third side surfaces 12 and 18, the midpoints H, I, K and L of the sub-side surfaces 14, 16, 20 and 22, respectively, provide the point of rotation for the sub-side surface such the shape and length of at least a portion of each sub-side surface on one side of the midpoint is a rotational image of at least a portion of the other side surface, rotated by 180°. More specifically, side surfaces 14, 20 and 22 include an S-shape section. The sub-side surface 16 in the embodiment depicted in FIG. 2 is a straight line (which is a 180° rotation about midpoint I), but in other embodiments can be or can include an S-shape section having complementary concave and convex portions. Further, although sub-side surfaces 14 and 20 of the FIG. 2 embodiment comprise S-shape sections, it is not required. Instead, sub-side surfaces 14 and 20 only need to be glide images, i.e., they have the same length and a complementary shape so that sub-side surface 14 of one unit can mate with sub-side 20 of another unit, and vice-versa. It is not required that sub-side surface 14 of one unit mate with sub-side 14 of another unit, or that sub-side surface 20 of one unit mate with sub-side surface 20 of another unit.

In the example of the building unit 10 discussed above, each of the side surfaces are preferably irregularly shaped and comprised of two or more straight line segments, however they can have more segments than the number shown in the example, or one or more of the line segments could include curved and jagged segments. Alternatively, one or more sides can be substantially straight, such as side 16 shown in FIG. 2. However, in the preferred embodiment, each of the side surfaces 12 and 18, sub-side surface 22, and optionally sub-side surface 16 should have S-shape sections, whereby each side surface can mate with the same side surface of another unit. This feature allows various ways of assembling the building units into structures, which will be described in greater detail below. Specifically, FIGS. 3-8 illustrate different mating relationships between the building units to form various structures.

Figure 3:
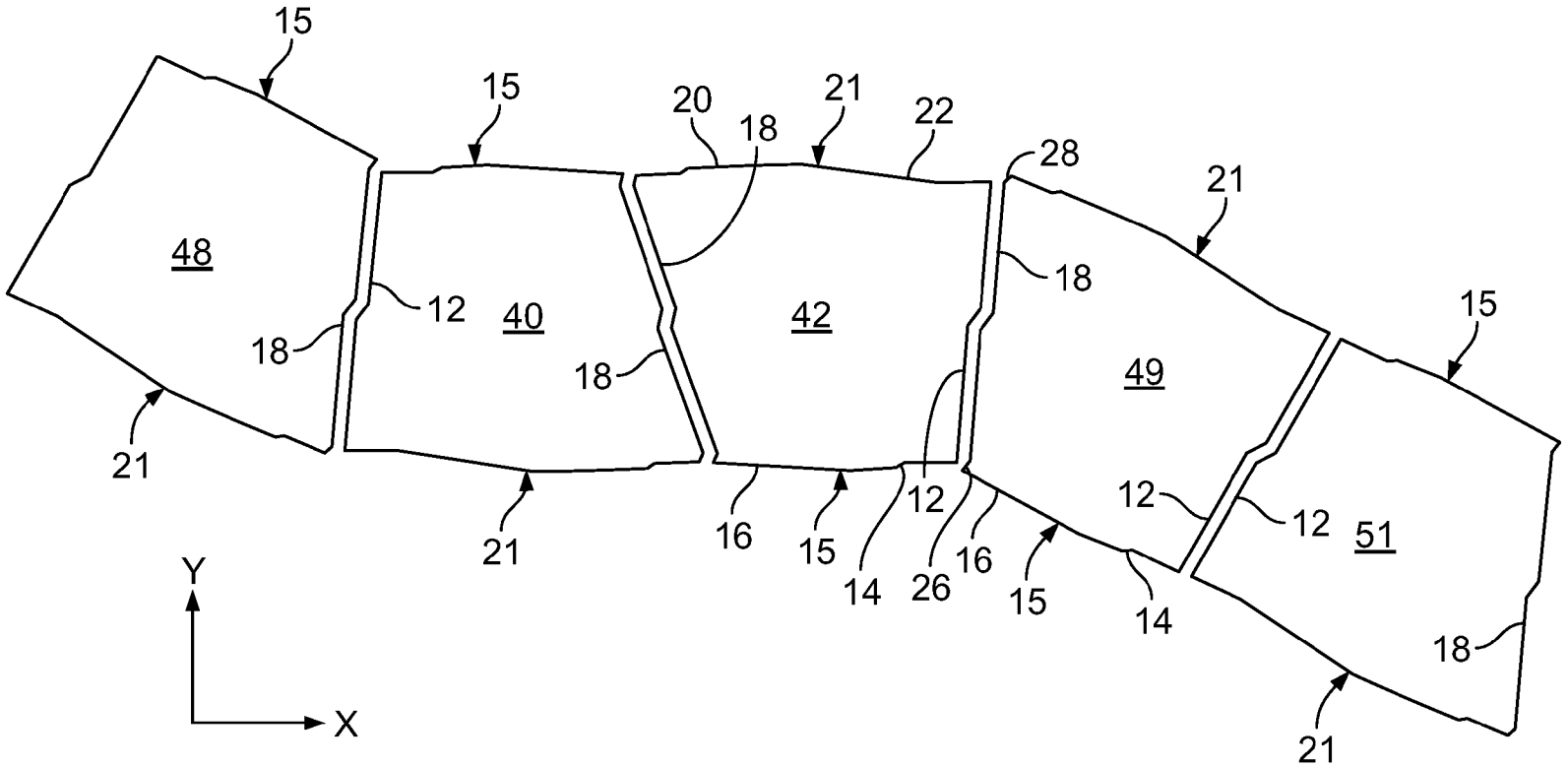
FIG. 3 is a plan view of a first exemplary use of the building unit forming an edger row.

Turning now to FIG. 3, an example application of the building unit is shown, wherein multiple building units are laid end-to-end forming a single course. Each of the building units 40, 42, 48, 49 and 51 have the same configuration as the building unit 10 of FIGS. 1 and 2. The course can be used as an edger row, or can represent one course in a wall structure. For clarity of illustration, the units are shown as being slightly spaced apart. It is intended, however, that in practice at least the base portions of the units will engage or abut one another so as to interlock with each other. Straight line, curved and serpentine courses, and combinations thereof, can be formed by selectively mating side surfaces 12 and 18. For example, the building unit 40 can mate with the building unit 42 because the fourth side surfaces 18 of each unit are configured to mate with each other. It should be noted that the orientation of the building unit 42 is rotated by 180° with respect to building unit 40 such that the second side surface 15 (i.e. the shorter side surface) is aligned with and visually appears somewhat as an extension of the fourth side surface 21 (i.e., the longer side surface). Such placement results in the adjacent building units 40 and 42 forming a relatively straight row. Of course, this pattern could be extended for more than two building units, resulting in a straight row of any desired number of units.

On the other hand, adjacent building units can be placed such that the two shorter side surfaces are next to each other and the two longer side surfaces are next to each other, such that each unit is angled relative the adjacent unit and the resulting row appears to angle or curve. For example, FIG. 3 shows building units 48 and 40 positioned adjacent to each other with side 12 of unit 40 mating with side 18 of unit 48. The fourth side surface 21 (the longer side surface) of unit 48 is aligned with the fourth side surface 21 (the longer side surface) of adjacent unit 40. Likewise, the two second side surfaces 15 (the shorter side surfaces) are aligned with one another. As a result, the resulting row includes an angle. A similar effect can be seen when considering the relationship between building units 42 and 49 of FIG. 3. The offset angle between building units can be calculated using the reference angles depicted in FIG. 2. In particular, the offset angle will be the sum of angles $\gamma$ and $\theta$.

Although FIG. 3 only includes five building units arranged to form a short serpentine course, it should be clear that any number of building units could be included to lengthen the path, and that those units could be positioned with like side surfaces (12-12 or 18-18) mating with each other to form a straight course, or with opposite side surfaces (12-18) mating with each other to form an angle or curved course. Further, a walkway or foot path could be made joining parallel courses. Walkways can be constructed in a straight line and/or including one or more angles or bends. Accordingly, it will be apparent to persons skilled in the art that multiple units can be assembled together in various combinations to form structures, such as a landscape edge rows and walkways, that are straight, curved in either direction, or serpentine as shown in FIG. 3.

FIG. 3 also illustrates how the inwardly inclined portion 28 of unit 49 acts as a softly inclined extension of the sub-side surface 22 of adjacent unit 42, thereby smoothing the visual transition between adjacent units in this area. On the other hand, the outwardly inclined portion 26 adjacent sub-side surface 16 of unit 49 acts in a somewhat hook-like manner to help secure the corner of adjacent unit 42 to unit 49, thereby promoting the structural integrity of the combination of units by minimizing shifting between units. The structural integrity of the combination of units is also promoted by the S-shape sections of the mating side surfaces (i.e., surfaces 12 to 12, surfaces 18 to 18, or surfaces 12 to 18) because the interlocking segments reduce the amount of shifting between adjacent units in the Y direction.

The FIG. 3 embodiment of a structure can also be viewed as a top plan view of one course of a partial wall section. Additional building units can be arranged on top of the first course to further provide at least a second course, and then more courses, if desired. Units in the second and successive courses can be, but need not be, staggered from left to right with respect to the units in the first course. Examples of such a staggered arrangement include, but are not limited to, running bond, half bond, quarter bond, three-quarter bond, etc. Non-staggered arrangements are also possible, including stack bond arrangements. Higher courses can be arranged in a vertical or near-vertical arrangement with respect to the lower courses, or can be arranged in a setback orientation for retaining wall structures. As suggested by FIG. 3, the wall structure may extend in a straight line, or comprise convex, concave or serpentine curves, or combinations thereof.

Figure 4:
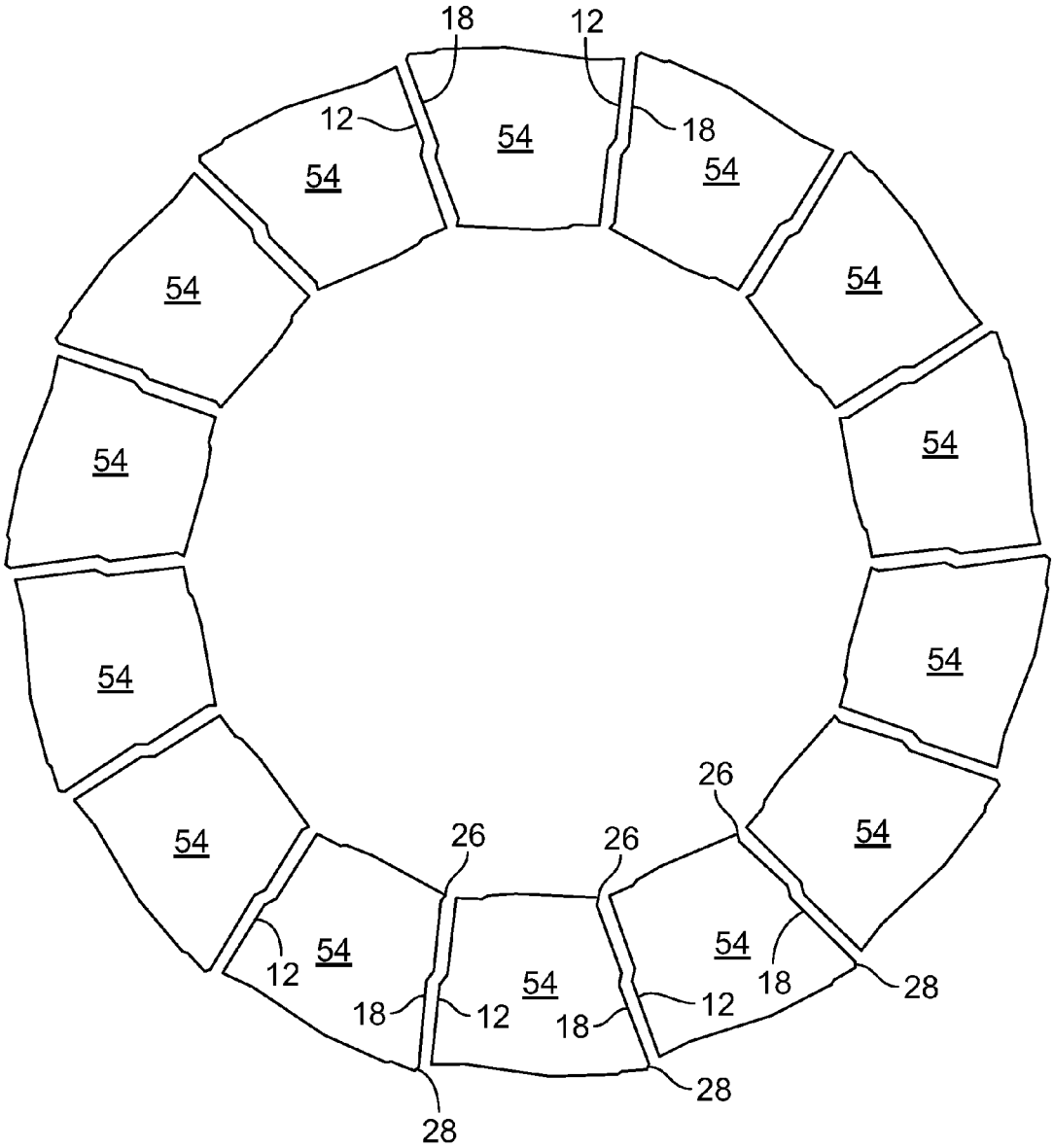
FIG. 4 is a plan view of a second exemplary use of the building unit forming an edger ring.

FIG. 4 shows another exemplary application of the building units of the present invention combined to form a ring course. As with FIG. 3, the units 54 in FIG. 4 are shown slightly spaced apart for clarity of illustration. The units 54 can be assembled in a ring, mating the first side surface 12 of one unit with the third side surface 18 of another unit since the first side surface 12 is an image of the midsection 24 of the third side surface 18, as explained above. The outwardly inclined portions 26 (also seen in FIG. 2) on the third side surface 18 wrap around and capture the end corners of the first side surface 12 to help secure the adjacent units together when assembled.

In the embodiment depicted in FIG. 4, fourteen building units 54 make a complete circle. Accordingly, each unit needs to have a "net angle" of 25.7 degrees (360 degrees divided by 14 units equals 25.7 degrees per unit), where the net angle is the sum of angles $\gamma$ and $\theta$, where angles $\gamma$ and $\theta$ are depicted in FIG. 2. Seven units would form a 180 degree, half circle. For the embodiment of FIG. 4, the angle $\gamma$ of the first side surface 12 can be approximately 6 degrees (i.e., 6 degrees from vertical or 84 degrees from the axis $A_x$), and the angle $\theta$ of the third side surface 24 can be approximately 20 degrees (i.e., 20 degrees from the vertical or 70 degrees from the axis $A_x$).

In alternative embodiments, the formula above (360/n) can be used to determine the net angle for creating a circle with different numbers of units, such as:

(i) For 9 units, the net angle would be 40 degrees (with, for example, angle $\gamma$ of 10 degrees and angle $\theta$ of 30 degrees);

(ii) For 12 units, the net angle would be 30 degrees (with, for example, angle $\gamma$ of 7 degrees and angle $\theta$ of 23 degrees);

(iii) For 16 units, the net unit angle would be 22.5 (with, for example, angle $\gamma$ of 4 degrees and angle $\theta$ of 18.5 degrees); and (iv) For 24 units, the net angle would be 15 degrees (with, for example, angle $\gamma$ of 0 degrees and angle $\theta$ of 15 degrees).

Of course, other variations on the desired number of units needed to make a circle and the exemplary angles mentioned above are contemplated as being within the scope of the present invention.

Figure 5:
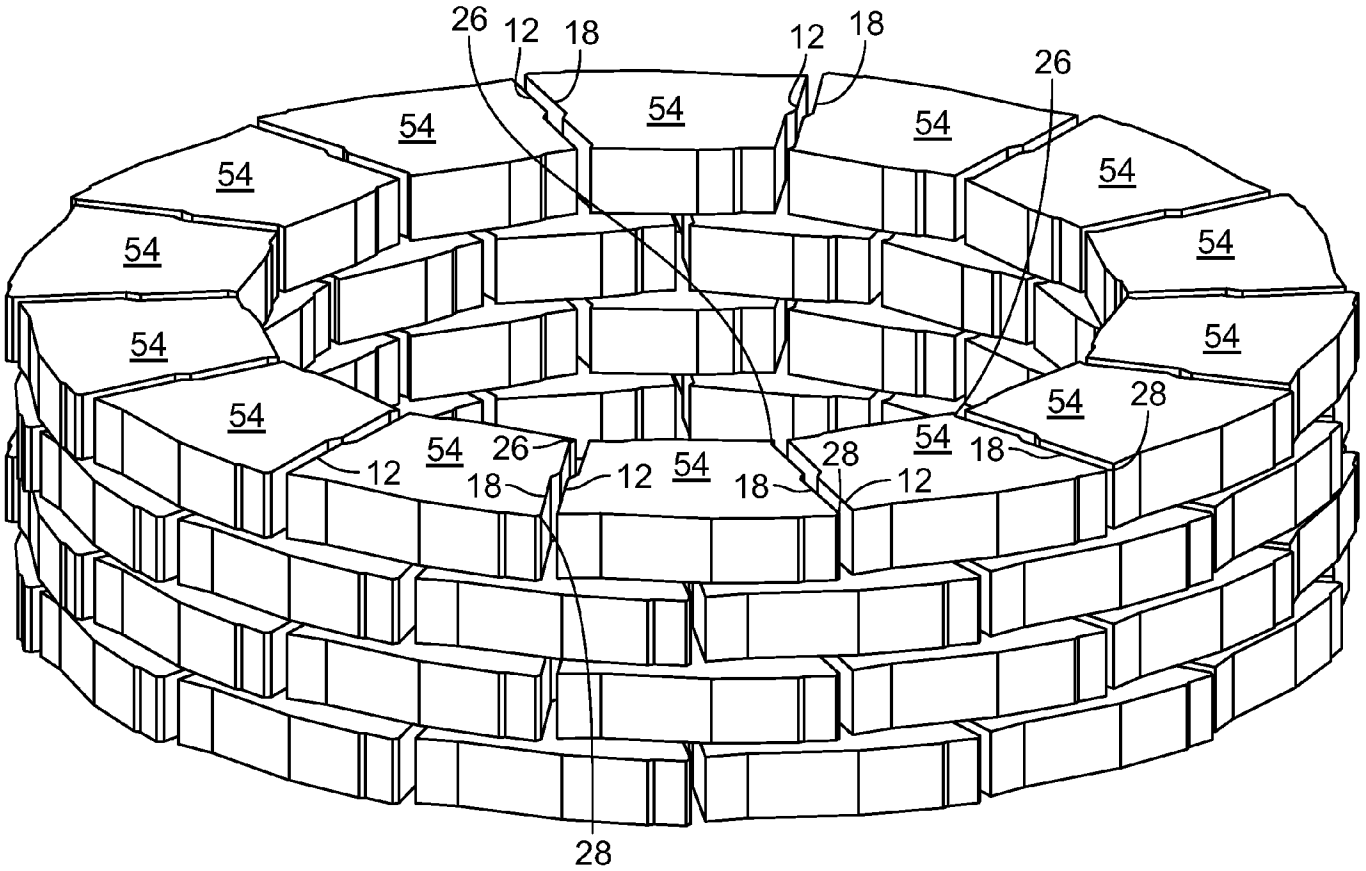
FIG. 5 is a perspective view of a third exemplary use of the building unit forming a circular wall or column.

As a further variance on the configuration of the ring course of FIG. 4, a decorative planter or column can be formed by adding multiple courses onto the ring course illustrated in FIG. 4. FIG. 5 illustrates a partial column embodiment comprised of multiple half bonded courses in a circular pattern. Of course other bonding configurations, such as three quarter bonding, are also contemplated. In the FIG. 5 embodiment, the units are preferably tight fitting, abutted against one another. However, in other embodiments the units can be slightly spaced for drainage, or optionally can be filled with mortar or other cement to provide more strength and integrity to the structure.

Figure 6:
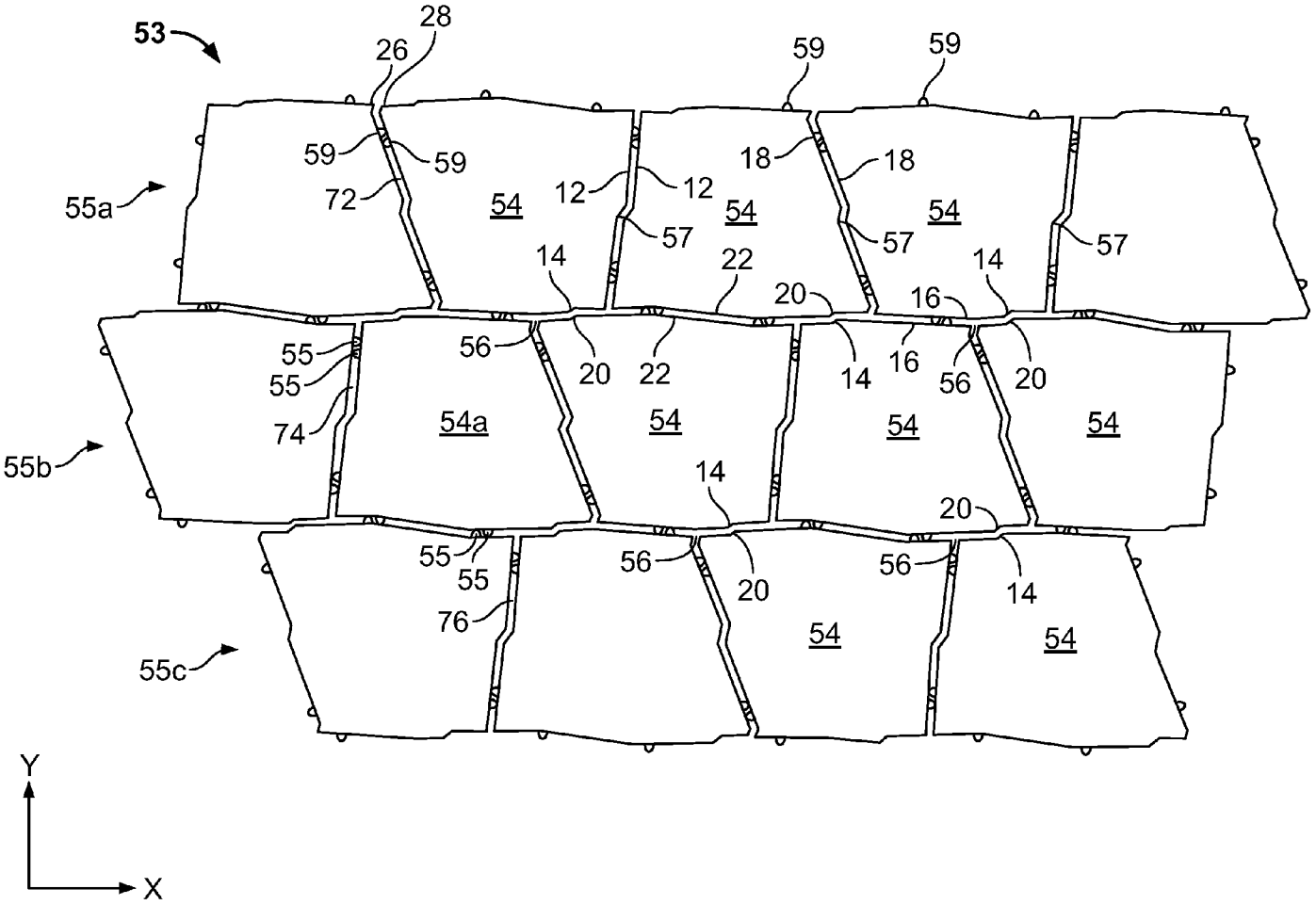
FIG. 6 is a plan view of a fourth exemplary use of the building unit forming a surface covering.

FIG. 6 shows another exemplary application of the building units of the present invention forming a surface covering structure 53. Again for clarity of illustration the units are shown as slightly spaced apart, but preferably abut one another at the base of the unit. Alternatively, the units can be slightly spaced apart with optional spacers 59, similar to the spacers disclosed for example in U.S. Pat. No. 7,393,155, which is hereby incorporated by reference. The spacers may be integrally molded with the unit, or can be separate pieces, e.g., plastic spacers, inserted when and where needed. Preferably the spacers are recessed from the visible surface so as not to detract from the finished appearance of the surface covering. As discussed above, the first side surfaces 12 mate with each other, as do the third side surfaces 18. Accordingly, each row 55*a*, 55*b*, and 55*c* in the surface covering 53 is interlocked in the row direction (i.e., the X direction in the FIG. 6 view). Reference number 57 of FIG. 6 represents the mating of side surfaces 12/12 or 18/18, which serve to minimize movement of adjacent building units in the direction represented as the Y direction in FIG. 6. The mating of the outwardly inclined portion 26 (FIG. 2) with an inwardly inclined portion 28 (FIG. 2) of an adjacent building unit also helps to minimize movement between adjacent units. Also, the sub-side surfaces 14 and 20 of units in adjacent rows mate and interlock. Also, adjacent sub-side surfaces 22 of units in adjacent rows mate and interlock with one another. Sides 16 of adjacent units abut one another. Accordingly, each internal unit 54 in the surface covering mates with six units and interlocks with up to six adjacent units, preferably at least four adjacent units.

Such mating and interlocking configuration minimizes movement in both the X and the Y directions of adjacent building units. Accordingly, the surface covering 53 is provided in which each unit interlocks with several adjacent units at multiple points and in multiple directions. Further structural integrity is provided by the three quarter bond, as shown in FIG. 6. Thus, it can be seen how central building unit 54 mates and interlocks with six adjacent building units.

With regard to the aesthetics of the structure of FIG. 6, there are multiple offsets with regard to the joints extending in the Y direction, which provides a desired appearance of the surface covering. For example, FIG. 6 shows that joint 72 of top row 55*a* is not aligned with and is at a different angle than joint 74 of adjacent middle row 55*b*. Also, joint 76 of bottom row 55*c* is offset relative to the joints of the middle row 55*b* immediately above it. Further, joint 76 of the bottom row 55*c* is not aligned with the joints of the top row 55*a*. Thus, in addition to adjacent row offsets of the joints, there are also offsets of the joints in alternate rows. In other words, in a three row structure, none of the joints extending generally in the Y direction will be aligned with each other. The joints of this embodiment, as well as those of other embodiments, can be filled with any desired filler, such sand, mortar, or grout, as desired.

Figure 7:
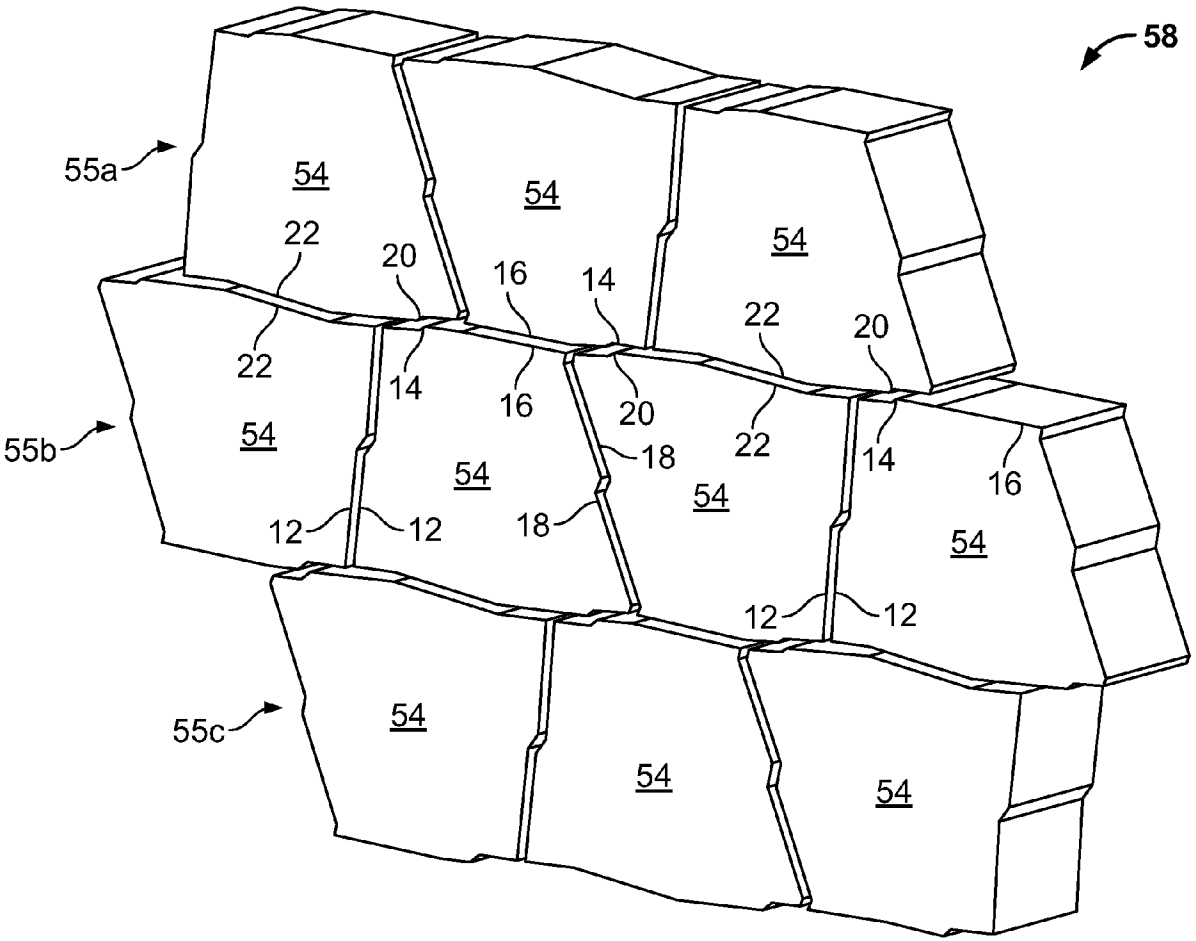
FIG. 7 is a perspective view of a variation on the fourth exemplary use of the building unit, wherein the surface covering is used to clad a vertical or vertically inclined structure.

FIG. 7 shows a perspective view of surface covering for a wall 58 formed of a configuration similar to that of the surface covering 53 of FIG. 6, where the same references numbers of FIG. 6 have been used. Such a wall 58 can be vertical, nearly vertical (i.e., having a slight setback as shown) or inclined.

Figure 8:
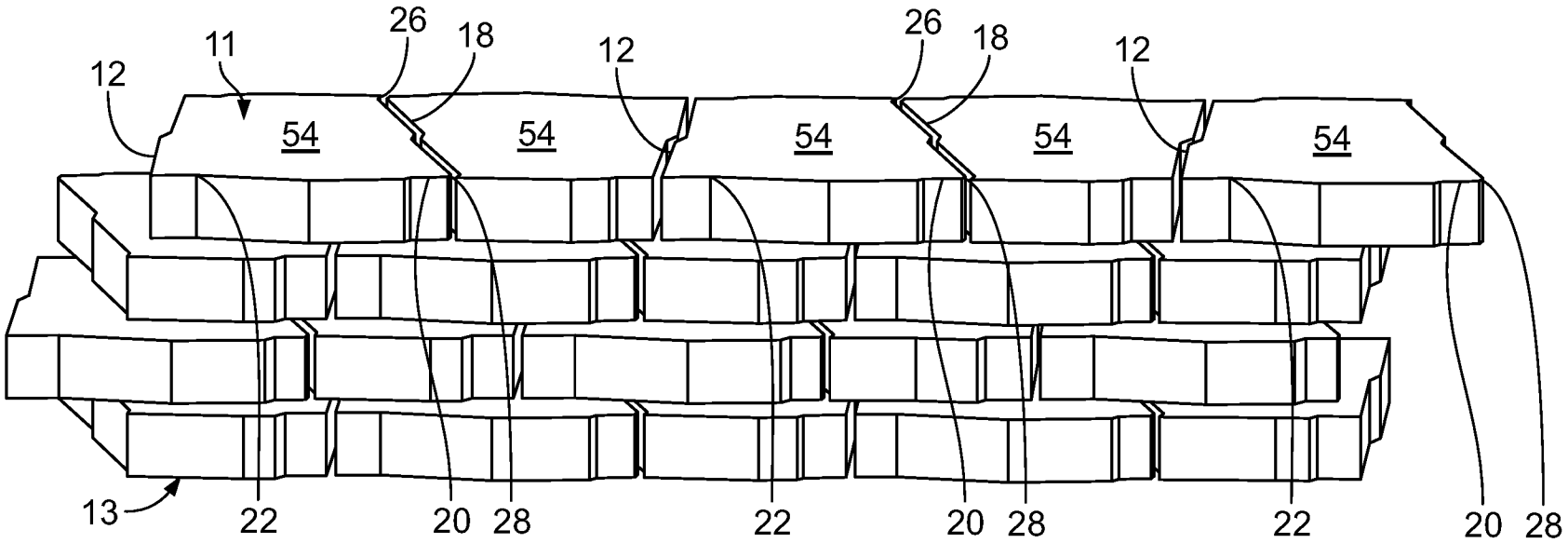
FIG. 8 is a perspective view of another exemplary use of the building unit forming a retaining wall.

FIG. 8 is an example application of the present building unit in combination with other building units to form a retaining wall, where the same reference numbers of FIG. 6 have again been used. In the FIG. 8 embodiment, building units 54 are arranged such that the first side surfaces 12 of adjacent units mate with each other, and the third side surfaces 18 of adjacent units mate with each other within a single course. Successive courses are placed upon the upper surfaces 11 of the units 54, and each successive course is set back, as shown. However, the set back could be omitted or minimized to provide a nearly vertical exterior surface, if desired. Although the wall of FIG. 8 is shown with each course extending linearly, angled or curved portions (such as shown in FIG. 3) could be added. As with the other embodiments, the joints between adjacent building units can optionally be filled with mortar or other cement. Further, the building units 54, can be configured to include cores, apertures and pins or other connectors to fix setbacks or to secure adjacent units together as shown and described in U.S. Pat. Nos. 6,447,213; 6,854,231; 7,168,892; and 6,615,561, which are each hereby incorporated by reference in their entirety.

Figure 9:
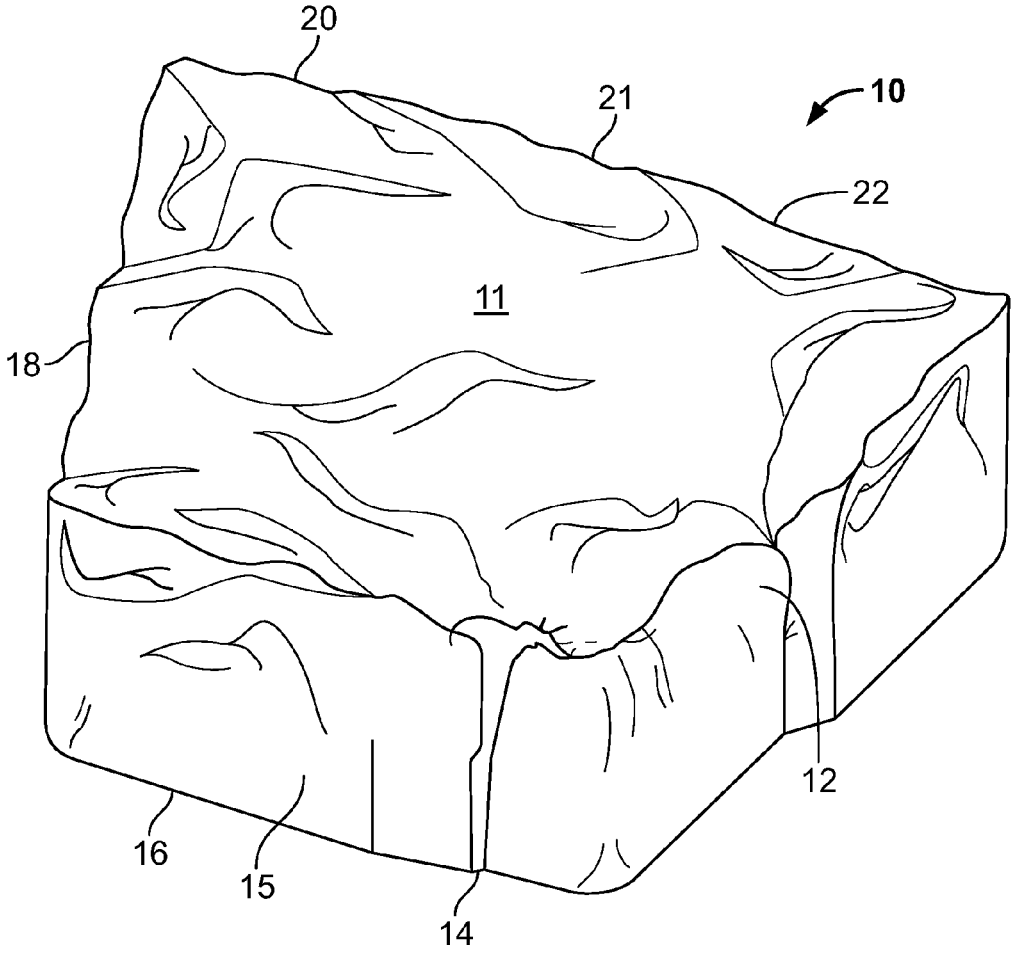
FIG. 9 is a perspective view of an exemplary building unit in accordance with another embodiment of the present disclosure in which the building unit includes irregular features sculpted therein.

To provide the building units with a more natural appearance, other embodiments may include natural rock features molded into the side surfaces and/or the upper surface of the unit, such as depicted in FIG. 9 for example, where the same reference numbers as the embodiment of FIGS. 1 and 2 have been used to depict the same features.

The side surfaces of the unit are preferably drafted, i.e., the side surfaces taper inwardly and progressively from bottom to top (based on the orientation of the unit in the mold). The degree of taper can vary in an irregular manner, both vertically and horizontally. Other portions of the outer periphery can be plumb. Natural rock features can be sculpted in the molds so the side surfaces appear rock-like. Further, the mold shoe that forms the top of the unit can be sculpted as well to impress natural rock features or other surface variations into the upper surface of the unit. The irregular drafted features in the sides of the unit can also be carried over into the upper surface of the unit. See, e.g., Applicant's co-pending U.S. provisional patent application Ser. No. 61/788,855, filed Mar. 15, 2013 entitled "Irregular Trapezoidal Wall Unit and Wall Structure Including Same" and U.S. Design Pat. No. D674, 510, which are hereby incorporated by reference in their entirety.

To further improve the natural appearance of surface coverings it is desirable to provide variations in individual building units. Dyes and colorants may be added to the units, and the color and quantity of dye may be regulated to produce color variations from unit to unit. Surface variations from unit to unit are also desirable. One method of introducing surface variation is to tumble the units after manufacture to roughen or to otherwise provide an aged appearance. These and other aging methods are well known in the art. An alternative method is to hammer the surfaces and/or edges of the unit to create small nicks or marks. Molded surface variations such as artificial joints or rock-like fissures can be utilized as well. For example, in a six form assembly, each mold can include a different surface irregularity or variation. Thereby, only every sixth unit would be the same.

The building units of the present invention may be made in any conventional manner, for example by molding concrete or other composite materials (such as clay, brick, plastic, natural or synthetic rubber, or various other materials). The embodiments of the present disclosure are particular well suited to dry cast molding methods that are well known in the art. Wet cast methods can also be used.

While various embodiments of the present invention have been shown and described, it should be understood that other modifications, substitutions, and alternatives are apparent to one of ordinary skill in the art. Such modifications, substitutions, and alternatives can be made without departing from the spirit and scope of the invention, which should be determined from the appended claims.

What is claimed is:

1. A building unit comprising:

an upper surface;

a lower surface; and a plurality of side surfaces at least partially extending between the upper surface and the lower surface defining a generally trapezoidal shape in plan view, wherein a first pair of said side surfaces, located on opposite sides of said building unit extend generally obliquely with respect to each other when considered in plan view, each of the first pair of side surfaces being non-linear and having a midpoint bisecting each side surface such that each side surface comprises two portions, the portions on each side of the midpoint being a 180 degree rotational image of the other portion about the midpoint, wherein one of the first pair of side surfaces is longer than the other, and the longer side surface includes a midsection that has the same length and configuration as the other, shorter side surface, wherein the shorter side surface of the first pair of side surfaces is configured and arranged to mate and interlock with either the shorter or longer of the first pair of side surfaces of another like building unit, and the longer side surface of the first pair of side surfaces is configured and arranged to mate and interlock with either the shorter or longer of the first pair of side surfaces of another like building unit.

2. The building unit of claim 1, wherein the first pair of side surfaces are irregularly shaped.

3. The building unit of claim 1, further comprising a second pair of side surfaces, located on opposite sides of said building unit, wherein each of said second pair of side surfaces extends between the side surfaces of said first pair of side surfaces.

4. The building unit of claim 3, wherein the length of one side surface of said second pair of side surfaces is longer than the length of the other side surface of said second pair of side surfaces, wherein the unit has a generally trapezoidal shape.

5. The building unit of claim 4, wherein each of said second pair of side surfaces defines a first sub-side surface and a second sub-side surface, and further wherein said first sub-side surface of the longer of said second pair of side surfaces is a mirror image of the first sub-side surface of the shorter of said second pair of side surfaces, such that the first sub-side surface of the longer side surface of one building unit is configured and arranged to mate and interlock with the first sub-side surface of the shorter side surface of an adjacent building unit.

6. The building unit of claim 4, wherein a second sub-side surface of the longer of said second pair of side surfaces is non-linear and has a midpoint bisecting second sub-side surface such that the sub-side surface comprises two portions, the portions on each side of the midpoint being a 180 degree rotational image of the other portion about the midpoint, wherein the second sub-side surface of the longer side surface of the second pair of side surfaces of one building unit is configured and arranged to mate and interlock with the same sub-side surface of another like building unit.

7. The building unit of claim 1, wherein the second pair of side surfaces are non-linear and irregularly shaped.

8. A building unit comprising:

an upper surface;

a lower surface; and a plurality of side surfaces at least partially extending between the upper surface and the lower surface defining a generally trapezoidal shape in plan view, wherein a first pair of said side surfaces, located on opposite sides of said building unit extend generally obliquely with respect to each other when considered in plan view, each of the first pair of side surfaces having an S-shaped section that are images of one another, such that each of said first pair of side surfaces are configured and arranged to interlock with either of the first pair of side surfaces of another like building unit;

a second pair of side surfaces, located on opposite sides of said building unit, wherein each of said second pair of side surfaces extends between the side surfaces of said first pair of side surfaces, and wherein one of the second pair of side surfaces is longer than the other;

wherein each of the second pair of side surfaces includes a first sub-side surface and a second sub-side surface, and further wherein said first sub-side surface of the longer of said second pair of side surfaces is a mirror image of the first sub-side surface of the other, shorter of said second pair of side surfaces, such that the first sub-side surface of the longer side surface of one building unit is configured and arranged to mate and interlock with the first sub-side surface of the shorter side surface of another like building unit; and wherein a longer one of the first pair of side surfaces is oblique to the second pair of side surfaces.

9. The building unit according to claim 8, wherein:

the longer side surface and the shorter side surface of the second pair of sides surfaces each include a second sub-side surface that is adjacent to the associated first sub-side surface, and further wherein the second sub-side surface of the longer side surface includes an S-shaped section.

10. The building unit according to claim 9, wherein, the first sub-side surface of both of the second pair of sides surfaces comprises an S-shaped section.

11. The building unit according to claim 9, wherein each of said first sub-side surfaces and said second sub-side surfaces of the second pair of side surfaces includes a midpoint, with a portion of said associated sub-side surface on one side of said associated midpoint being a 180° rotational image of another portion of said associated sub-side surface.

12. The building unit according to claim 8, wherein the first pair of side surfaces are non-linear and irregularly shaped; and the second pair of side surfaces are non-linear and irregularly shaped.

13. A structure comprising:

a plurality of building units arranged adjacent to each other, wherein each of said building units comprises:

an upper surface;

a lower surface; and four side surfaces at least partially extending between the upper surface and the lower surface, wherein said four side surfaces includes a first pair of said side surfaces, located on opposite sides of said building unit and defined as a first side surface and a third side surface, and a second pair of said side surfaces, located on opposite sides of said building unit and defined as a second side surface and a fourth side surface, wherein said four side surfaces of each building unit define a generally trapezoidal shape when considered in plan view, wherein each of said four side surfaces is non-linear and has a plurality of segments, wherein said first pair of side surfaces extend generally obliquely from each other and said second pair of side surfaces extend generally parallel to each other, wherein said second pair of said side surfaces have different lengths, herein said first and third side surfaces each include an S-shaped section, and wherein said first and third side surfaces each have a midpoint bisecting each side surface such that each side surface comprises two portions, said portions on each side of said midpoint being a 180 degree rotational image of said other portion about said midpoint, and wherein said plurality of building units are arranged in a course in which adjacent building units are positioned with the first side surface of one building either mating with the first side surface of an adjacent building unit, or with the first side surface of one building unit mating with the third side surface of an adjacent building unit.

14. The structure according to claim 13, wherein said course includes at least one pair of adjacent building units in which the first side surface of one building unit mates with the first side surface of an adjacent building unit, and at least another pair of adjacent building units in which the first side surface of one building unit mates with the third side surface of an adjacent building unit.

15. The structure according to claim 13, wherein each of said building units of said pattern is arranged such that the first side surface of one building unit mates with the third side surface of an adjacent building unit, whereby the course defines a generally circular shape, in plan view.

16. The structure according to claim 13, wherein each of said building units of said course is arranged such that the first side surface of one building unit mates with the first side surface of an adjacent building unit and the third side of one building unit mates with the third side surface of an adjacent building unit, whereby the pattern defines a generally straight course, in plan view.

17. The structure according to claim 16, wherein said structure includes at least a plurality of said courses that are positioned adjacent to each other in plan view, wherein each of the side surfaces of the second pair of sides mate and interlock with at least one unit in an adjacent course, and wherein joints between adjacent building units within one course being offset from joints between adjacent building units of an adjacent course.

18. A structure comprising:

a plurality of building units arranged adjacent to each other, wherein each of said building units comprises:

an upper surface;

a lower surface; and a plurality of side surfaces at least partially extending between the upper surface and the lower surface defining a generally trapezoidal shape in plan view, wherein the plurality of said side surfaces includes a first pair of said side surfaces, located on opposite sides of said building unit and defined as a first side surface and a third side surface, and a second pair of said side surfaces, located on opposite sides of said building unit and defined as a second side surface and a fourth side surface, wherein the first side surface and the third side surface are non-linear and extend generally obliquely with respect to each other, when considered in plan view, and further wherein the first and third side surfaces each include an S-shaped section, the S-shaped sections of the first and third side surfaces being images of one another, wherein the third side surface is oblique to the second and fourth side surfaces, and wherein said plurality of building units are arranged in a pattern in which adjacent building units such that:

the first side surface of one building unit mates with the first side surface of an adjacent building unit, the second side surface of one building unit mates with portions of the second and fourth side surfaces of two adjacent building units, the third side surface of one building unit mates with the third side surface of an adjacent building unit, and the fourth side surface of one building unit mates with portions of the second and fourth side surfaces of two adjacent building units.

19. The structure according to claim 18, wherein said pattern includes at least one building unit that interlocks with at least five adjacent units, whereby:

the first side surface of the one building interlocks with the first side surface of a first adjacent building unit, the second side surface of the one building unit interlocks with a portion of the fourth side surface of a second adjacent building unit, the third side surface of the one building unit interlocks with the third side surface of a third adjacent building unit, and the fourth side surface of the one building unit interlocks with a portion of the second side surface of a fourth adjacent building unit and interlocks with a portion of a the fourth side surface of a fifth adjacent building unit.

* * * * *